United States Patent [19]

Webb

[11] Patent Number: 4,897,945

[45] Date of Patent: Feb. 6, 1990

[54] LOCK BOX DOOR PROTECTOR

[76] Inventor: Larry R. Webb, 2008 Stanley Rd., Cazenovia, N.Y. 13035

[21] Appl. No.: 258,660

[22] Filed: Oct. 17, 1988

[51] Int. Cl.[4] ..... G09F 3/00

[52] U.S. Cl. ..... 40/331; 40/617; 40/649

[58] Field of Search ..... 40/331, 124.2, 642, 40/310, 617, 649; 229/74; 206/806; 49/460

[56] References Cited

U.S. PATENT DOCUMENTS

| | | | |
|---|---|---|---|
| 1,161,295 | 11/1915 | Eastman | 40/331 |
| 1,529,381 | 3/1925 | Townsend | 229/74 |
| 1,853,622 | 4/1932 | Kennedy | 40/310 |
| 1,984,559 | 12/1934 | Wilcox | 229/74 |
| 2,636,209 | 4/1953 | Tedder | 16/1 R |
| 3,319,369 | 5/1967 | Severson | 40/642 |
| 3,704,037 | 11/1972 | Glassberg | 293/128 |
| 4,134,280 | 1/1979 | Pelavin | 70/55 |
| 4,216,598 | 8/1980 | Newbert | 40/617 |
| 4,460,119 | 7/1984 | Goodfellow et al. | 229/68 R |
| 4,539,936 | 9/1985 | Majewski | 119/29 |
| 4,545,521 | 10/1985 | Hiersteiner | 229/68 R |

FOREIGN PATENT DOCUMENTS

| | | | |
|---|---|---|---|
| 247276 | 5/1966 | Austria | 40/315 |
| 171737 | 3/1935 | Switzerland | 40/315 |

*Primary Examiner*—Cary E. Stone

*Attorney, Agent, or Firm*—Wall and Roehrig

[57] ABSTRACT

A lock box door protector prevents doors to new or unoccupied homes from being scratched by realtor's lock boxes. The lock box door protector comprises a plastic sleeve or strip that fits over the doorknob and is positioned between the door and the lock box. A pocket on the lock box door protector proffers a supply of business cards to potential buyers.

6 Claims, 1 Drawing Sheet

LOCK BOX DOOR PROTECTOR

BACKGROUND OF THE INVENTION

This invention relates to abrasion shields, especially for protecting a door from being scratched. The invention is more particularly directed to a flexibly resilient lock box door protector that shields a door from scratches from a realtor's lock box, identifies the realtor by name, and provides a place for conveniently dispensing the realtor's business cards to drive-bys.

At the present time, when a new or unoccupied home is being shown by a realtor, the realtor generally gains access to the home via a lock box which is locked to the doorknob stem on the front door of the home. The lock box itself is a small key safe, which is opened by another key in the realtor's possession. These boxes, which contain keys to the house, are loosely suspended on the doorknob stem, and can swing and scrape the door every time that the door is opened or closed. The key box can result in chipped paint or other damage on the front door. The doors of many new homes are scratched by movement of the lock boxes. Often, the door is so badly scratched by the hanging lock box that it is necessary to repaint the door before the new owner moves in.

The lock box itself does not provide any identification of the realtor, and certainly does not provide any way for any prospective home buyer who sees the home while driving past in the neighborhood, i.e., a drive-by, to learn how to contact the real estate agent.

OBJECTS AND SUMMARY OF THE INVENTION

Accordingly, it is an object of this invention to provide a lock box door protector which prevents scratching of the door from the lock box.

It is another object of this invention to provide a lock box door protector that incorporates suitable means for dispensing business cards and/or other information concerning the realtor.

According to an aspect of this invention, the lock box door protector protects the stile of the door from abrasion or damage when the lock box is hung from the doorknob stem. The door protector also proffers a supply of the realtor's business cards. The door protector comprises an elongated strip of a flexible resilient material, preferably a plastic film such as vinyl, with an opening at the upper end to be placed over the doorknob and suspended from the stem. A pocket is formed at the lower end of the strip to contain the supply of business cards. The strip is of sufficient length so that the pocket protrudes below the base of the lock box of standard size when it is suspended from the doorknob stem over the protector. Preferably the protector is formed of a sleeve or double panel of vinyl film, that is, a clear panel in front and a colored, white, or opaque panel behind. Access to the business cards is obtained through a slit in the back panel. This access from rear feature protects the business card from rain or other weather elements. The realtor's logo, name, and phone number can be printed on the protector in the space between the bottom of the lock box and the top of the pocket. On the clear front of the pocket can be printed suitable indicia, such as "Please Take Card", to encourage an interested person to take a business card from the supply of cards in the pocket. The opening for hanging the door protector is suitably shaped so as to provide full protection from the body of the lock box, and still fit over the doorknob.

The above and many other objects, features, and advantages of this invention will be more fully understood from the ensuing description of a preferred embodiment, which should be read in connection with the accompanying Drawing.

DETAILED DESCRIPTION OF THE PREFERRED EMBODIMENT

Figure 1:
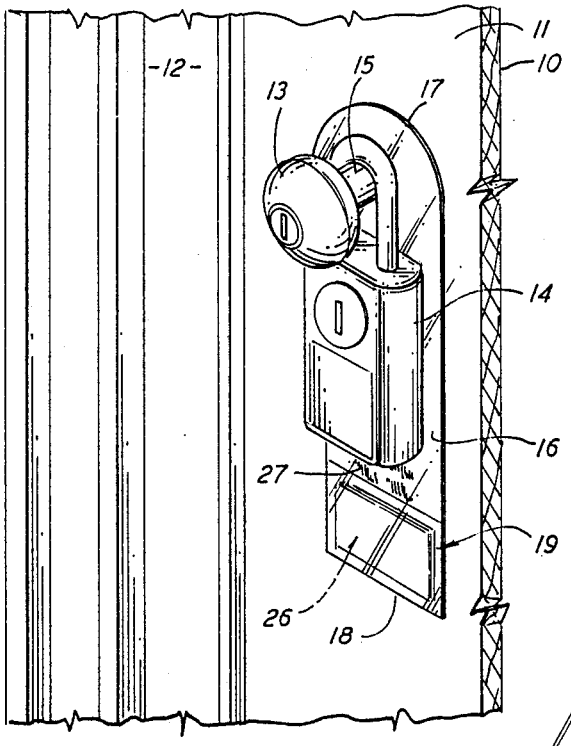
FIG. 1 is an environmental perspective view of a portion of the front door of a home, showing a realtor's lock box, and a lock box door protector according to an embodiment of the present invention.

With reference to the Drawings, and initially to FIG. 1, a portion of a door 10 is shown with a stile 11 thereof against a door frame 12. A knob 13 protrudes from the front of the door and a lock box 14 of a standard size in the trade is suspended from a stem 15 of the knob 13. A round knob is shown for purposes of this illustration, but the same principle could be employed, for example, with a lever type latch.

A door protector 16 according to an embodiment of this invention hangs from the doorknob stem 15 between the lock box 14 and the door 10. The protector 16 has a rounded top end 17 and a generally flat bottom end 18, at which a business card pocket 19 is located. To accommodate a standard lock box 14, as shown, the protector 16 is substantially nine inches long and four inches wide.

Figure 2:
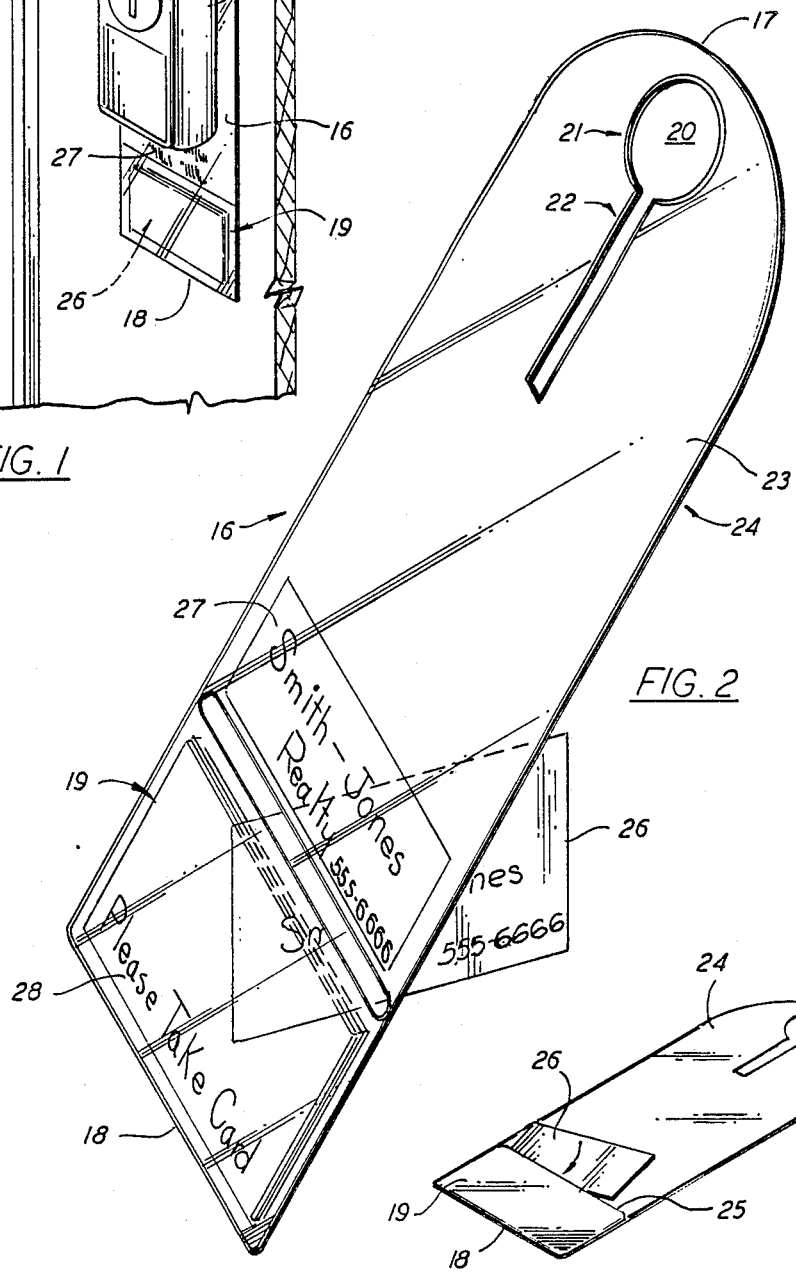
FIG. 2 is a perspective view of the front of the lock box door protector.
Figure 3:
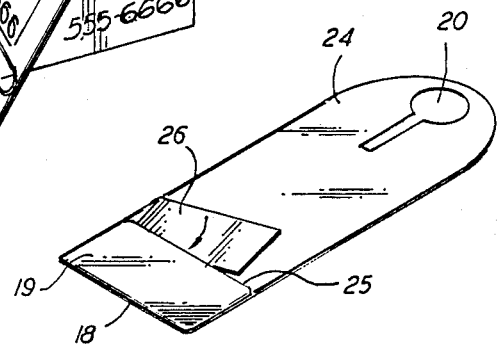
FIG. 3 is a perspective view of the rear of the lock box door protector.

As shown in FIGS. 2 and 3, the door protector 16 is formed of a strip of resilient flexible material, preferably vinyl film. An opening 20 to fit over the doorknob 13 is formed near the strip top end 17. The opening 20 is keyhole-shaped, being formed of a circular aperture 21, approximately one inch in diameter, with a slit 22 protruding about two inches downward from the bottom of the circular aperture. This shape is significant in that the opening 20 will flex to fit over the doorknob 13, and then will resume the original keyhole shape so as to provide maximum coverage behind the body of the lock box 14.

As also shown in FIG. 2 and 3, the door protector strip 16 is formed of a front panel 23 of clear transparent vinyl and a rear panel 24 of vinyl, which can be white or colored, or otherwise opaque. These two panels 23 and 24 are preferably heat welded at their edges, around the periphery of the opening 20, and above the pocket 19.

The card pocket 19 is dimensioned to hold a suitable supply of business cards of standard dimensions, that is, two inches by three-and-one-half inches. There is a slit 25 in the rear panel 24 at the top of the pocket 19, for access to the business cards 26 therein. Preferably there is no opening through the front panel 23, so that the supply of cards 26 therein will be shielded from the weather. The pocket 19 will hold about ten cards 26.

There is also space between the bottom edge of the lock box 14 and the top of the pocket 19. This space can be printed with suitable indicia 27 such as the realtor's logo and telephone number. Also, suitable indicia 28 can be provided on the clear front panel of the pocket 19, such as "Please Take Card", or other words to suggest that a prospective buyer take one of the business cards 26 from the supply in the pocket 19.

The lock box door protectors of this invention not only protect the door from scratching, but yield important information to prospective buyers.

While this invention has been described in detail with reference to a single preferred embodiment, it should be understood that the invention is not limited to that embodiment. Rather, many modifications and variations would present themselves to those skilled in the art without departing from the scope and spirit of this invention, as defined in the appended claims.

What is claimed is:

1. A lock box door protector for protecting the stile of a door from abrasion or damage when a realtor's key lock box is hung from a doorknob stem thereon, and which also proffers a supply of business cards, the door protector comprising an elongated strip of a resilient material having an upper end and a lower end, with an opening at said upper end to be placed over said doorknob and suspended from said stem, a pocket formed at the lower end of said strip to contain said supply of business cards, and said strip being of sufficient length so that said pocket is positioned below the base of a standard lock box suspended from the doorknob stem over said protector;

wherein said pocket includes means visibly displaying said cards while protecting them from the weather;

wherein the strip is of two layers at least at said lower end, with a clear plastic front layer and another layer behind to define said pocket; and wherein said other layer has a slit therein for access to said business cards from behind the door protector.

2. A lock box door protector according to claim 1, wherein said strip consists of a front layer of transparent vinyl and a rear layer of an opaque vinyl.

3. A lock box door protector according to claim 1 wherein said strip includes an area between a top edge of said pocket and a bottom of said standard lock box, and indicia printed in said area to identify a realtor who can be contacted.

4. A lock box door protector according to claim 1 wherein said pocket is printed with indicia to encourage an interested person to take a business card from said pocket.

5. A lock box door protector according to claim 1 wherein said strip is dimensioned substantially nine inches long by four inches wide.

6. A lock box door protector according to claim 1 wherein said opening consists of a circle of substantially one inch diameter and a slit extending from a lower edge of the circle substantially two inches towards said lower end.

* * * * *